US009670643B2

(12) United States Patent
Caux et al.

(10) Patent No.: US 9,670,643 B2
(45) Date of Patent: Jun. 6, 2017

(54) EXCAVATOR BUCKET AND EARTH MOVING MACHINE

(71) Applicant: Liebherr-Mining Equipment Colmar SAS, Colmar (FR)

(72) Inventors: Brice Caux, Montjoire (FR); Martial Vicq, Colmar (FR); Gerard Weber, Meyenheim (FR); Oliver Weiss, Ammerschwihr (FR)

(73) Assignee: Liebherr-Mining Equipment Colmar SAS, Colmar (FR)

( * ) Notice: Subject to any disclaimer, the term of this patent is extended or adjusted under 35 U.S.C. 154(b) by 0 days.

(21) Appl. No.: 14/188,144

(22) Filed: Feb. 24, 2014

(65) Prior Publication Data

US 2014/0237869 A1 Aug. 28, 2014

(30) Foreign Application Priority Data

Feb. 25, 2013 (EP) ..... 13000949

(51) Int. Cl.
*E02F 3/40* (2006.01)

(52) U.S. Cl.
CPC ..... *E02F 3/40* (2013.01); *Y10T 29/49826* (2015.01)

(58) Field of Classification Search
CPC .. E02F 3/40; B23K 9/04; B23K 9/042; B23K 9/044; B23K 9/046; B23K 9/048
USPC .... 228/164, 170, 171, 182; 219/76.1, 76.12, 219/76.14, 76.15
See application file for complete search history.

(56) References Cited

U.S. PATENT DOCUMENTS

| | | | | |
|---|---|---|---|---|
| 2,458,645 | A * | 1/1949 | Rosenberg et al. | 29/896.412 |
| 2,972,425 | A * | 2/1961 | Anderson | E02F 3/40 37/379 |
| 3,452,425 | A * | 7/1969 | Stanley et al. | 29/445 |
| 3,807,587 | A * | 4/1974 | Maurer | 37/444 |
| RE29,603 | E * | 4/1978 | Oke et al. | 414/722 |
| 4,129,952 | A * | 12/1978 | Olson | 37/444 |
| 4,314,789 | A * | 2/1982 | Luigi | E02F 3/3677 37/379 |
| 4,477,987 | A * | 10/1984 | Stecklein | 37/444 |
| 4,523,397 | A * | 6/1985 | Lucas | 37/444 |
| 5,815,959 | A * | 10/1998 | Bahner et al. | 37/444 |

(Continued)

FOREIGN PATENT DOCUMENTS

| | | |
|---|---|---|
| GB | 1222056 A | 2/1971 |
| JP | 51131001 U | 10/1976 |

(Continued)

OTHER PUBLICATIONS

ESCO Corporation, ESCO Universal Wear Solutions, 2009, http://www.hlmesabi.com/ESCOWear.pdf.*

(Continued)

*Primary Examiner* — Jamie L McGowan
(74) *Attorney, Agent, or Firm* — McCoy Russell LLP

(57) ABSTRACT

An excavator bucket for an earth moving machine includes an interior bucket space formed by a curved rear wall and a pair of opposed sidewalls, with the bucket including a bucket box arranged onto the rear wall, in particular arranged on the outer surface of its top portion, which extends along a lateral axis of the bucket. The angle between at least one of the outer lateral sides of the bucket box and the rear wall of the bucket, in particular its top portion, is less than 90 degrees.

20 Claims, 3 Drawing Sheets

(56) References Cited

U.S. PATENT DOCUMENTS

| | | | | |
|---|---|---|---|---|
| 5,832,638 | A * | 11/1998 | Watts | 37/396 |
| 5,852,272 | A * | 12/1998 | Amano | 219/76.14 |
| 6,581,308 | B1 * | 6/2003 | Woerman et al. | 37/444 |
| 7,832,128 | B2 * | 11/2010 | Doucette et al. | 37/444 |
| 7,992,329 | B2 * | 8/2011 | Horton | E02F 3/40 37/379 |
| 8,069,593 | B2 * | 12/2011 | McClallen et al. | 37/444 |
| 8,631,595 | B2 * | 1/2014 | McDonald | 37/417 |
| 8,875,422 | B2 * | 11/2014 | Tanaka et al. | 37/444 |
| 9,015,970 | B1 * | 4/2015 | Doucette | 37/444 |
| 2005/0268500 | A1 * | 12/2005 | Imamura et al. | 37/411 |
| 2008/0010870 | A1 | 1/2008 | Horton | |
| 2009/0183398 | A1 | 7/2009 | McClallen et al. | |
| 2010/0037493 | A1 * | 2/2010 | Kim et al. | 37/444 |
| 2011/0289803 | A1 * | 12/2011 | Folkerts et al. | 37/444 |
| 2013/0323000 | A1 * | 12/2013 | Rochel et al. | 414/722 |

FOREIGN PATENT DOCUMENTS

| | | | |
|---|---|---|---|
| JP | 5863258 | U | 4/1983 |
| JP | 2010163832 | A | 7/2010 |
| KR | 1020050032061 | A | 4/2005 |
| WO | 2011011825 | A1 | 2/2011 |

OTHER PUBLICATIONS

ISA European Patent Office, Partial European Search Report Issued in EP13000949, Jul. 30, 2013, Germany, 7 pages.

* cited by examiner

EXCAVATOR BUCKET AND EARTH MOVING MACHINE

CROSS REFERENCE TO RELATED APPLICATION

This application claims priority to European Patent Application Serial No. 13 000 949.1, entitled "Excavator Bucket and Earth Moving Machine," filed Feb. 25, 2013, which is hereby incorporated by reference in its entirety for all purposes.

TECHNICAL FIELD

The present disclosure relates to an excavator bucket for an earth moving machine comprising an interior bucket space formed by a curved rear wall and a pair of opposed sidewalls. Further, the present disclosure relates to an earth moving machine comprising an excavator bucket.

BACKGROUND AND SUMMARY

Excavator buckets are used as accessory equipment for earth moving machines. Today, a variety of bucket configurations for different applications is available on the market. The bucket shape usually resides from the hydraulic excavator kinematics. Current developments and improvements of excavator buckets are regularly directed to an increase of the daily production in terms of the amount of material moved or to the reduction of wear of the bucket material. However, developments regarding the volume/weight ratio of the bucket have not been promoted as necessary in the past.

The inventors herein have recognized the above issues and therefore have aim to provide a solution for an excavator bucket which increases the volume/weight ratio.

The aforementioned object is solved by an excavator bucket for an earth moving machine, in particular a mining machine, comprising an interior bucket space for grabbing material to be moved. The interior bucket space is formed by a curved rear wall and a pair of opposed sidewalls.

The bucket according to the present disclosure is constructed in a box-type manner. A bucket box is arranged on the top surface of the bucket in a bucket area which comprises attachment devices for attaching the bucket to an excavator arm.

The bucket box is arranged at the rear wall, in particular arranged on the outer surface of its top portion. Further, the bucket box extends along a lateral axis of the bucket. According to the present disclosure the weight of the bucket, in particular the weight of the used bucket box is reduced if the angle between at least one bucket box front wall and the rear wall of the bucket, in particular its top portion, is less than 90 degrees. Consequently, the resulting bucket box comprises two front sides or rather outer lateral sides which are inclined to a vertical axis. The total material for manufacturing the bucket is significantly decreased although the resulting bucket volume remains constant.

According to a preferred aspect of the present disclosure the ratio between the bucket volume and its weight can be increased by a bucket construction with an angle between at least one sidewall and the curved rear wall which is greater than 90 degrees. Hereby, the bucket capacity can be appreciable increased. Further, only a very low weight increase has to be accepted. With a given bucket lip width the bucket width can be increased on a sidewall level so that the bucket volume increases.

The angle between at least one sidewall and the rear wall is not necessarily constant over the complete contacting area. It might be sufficient if some parts of the contacting area of side wall and rear wall draw an angle greater than 90 degrees.

In a preferable aspect of the present disclosure the curved rear wall is separated into a top portion and a base portion, wherein the sidewalls are located between the top and base portion. According to the preferred aspect the angle between at least one sidewall and the top portion and/or the base portion is greater than 90 degrees. The angle between at least one sidewall and the top portion and/or base portion is not necessarily constant over the complete contacting area. However, best effort is achieved with an angle between the top portion and the sidewall and with an angle between the base portion and at least one sidewall which are both greater than 90 degrees.

The best volume to weight ratio is achievable when both sidewalls are connected to the rear wall in an angle of more than 90 degrees.

It is possible to optimise the shape of the bucket box for further reduction of the overall weight of the bucket, in particular the weight of the bucket box. A good optimisation is achievable by accomplishing the bucket box as a hollow box wherein the longitudinal axis of the bucket box extends along the lateral axis of the bucket.

In particular, a bucket box comprises a four-corner cross-section area with rounded corners. Such a cross shape will show good properties with respect to its own weight. Ideally the four-corner cross-section area has rounded corners wherein the sides of the cross-section area differ from each other in their length and/or their orientation. Weight optimisation resists in the same way to the stresses generated by excavator work forces. Considering the aforementioned preferred modifications of the bucket box, a clear reduction of weight up to 30% compared to the weight of known boxes is possible. Both outer lateral sides may be inclined to a vertical axis, for example inclined to each other.

In a further preferred embodiment, the rear wall consists of at least two metal sheets which are brought together during manufacturing of the bucket to get a cambered and/or round shaped rear wall. These metal sheets are neither pressed nor molded. Instead, it is practical when the at least two metal sheets are indeed laminated, cut and welded together. Hereby, the bucket volume can be significantly increased without noticeable increase of the total weight of the bucket.

In a further preferred embodiment the top portion of the rear wall forms at least partly a circular shape. Former rear wall shapes may be rounded but usually include a straight portion forming the bucket top surface. According to a preferred embodiment of the present disclosure this portion is replaced by a top portion which forms at least partly a circular shape. The circular shape enlarges the available bucket volume.

For an improvement of the bucket lifetime it is very common to use wear packages. These wear packages are most of the time plates with a higher hardness face and which are welded on the bucket structure. According to a preferred embodiment of the present disclosure, instead, a carbide overlay is disposed at least partly on at least one defined structural bucket part which is intensely stressed.

It is very preferable when the aforementioned carbide overlay is disposed directly on the structural part after a cutting process of the bucket material and before a forming and welding process of the bucket material. The overlaying is feasible with a mechanical process.

Ideally, the used carbide overlay includes tungsten carbides which is very hard and can resist during the complete bucket lifetime. Therefore, it is possible to reduce the total bucket weight as the recharging is done directly on the bucket structure.

In an advantageous aspect of the present disclosure the bucket comprises at least one attachment flange for attaching the bucket to an excavator arm of an earth moving machine. It is possible that the bucket comprises at least two attachment flanges, each having one or more openings for a releasable connection of the bucket to an excavator arm of an earth moving machine.

It might be possible that at least one attachment flange is connected to the bucket box and/or the rear wall, in particular to its top portion.

The present disclosure is further directed to an earth moving machine comprising a bucket according to the present disclosure or according to any one of the preferred embodiments of the present disclosure. The earth moving machine may have hydraulic devices, such as hydraulic pumps, lines, accumulators, and control valves thereon for operating the attached bucket.

Obviously, the advantages and properties of the earth moving machine correspond to these of the inventive bucket. Therefore, a repeating description of the earth moving machine is deemed to be unnecessary.

Further properties and characteristics of the present disclosure should be explained in the following with respect to an embodiment given in the figures.

BRIEF DESCRIPTION OF THE FIGURES

FIG. 6 shows two front views of the inventive bucket.

DETAILED DESCRIPTION

Figure 1:
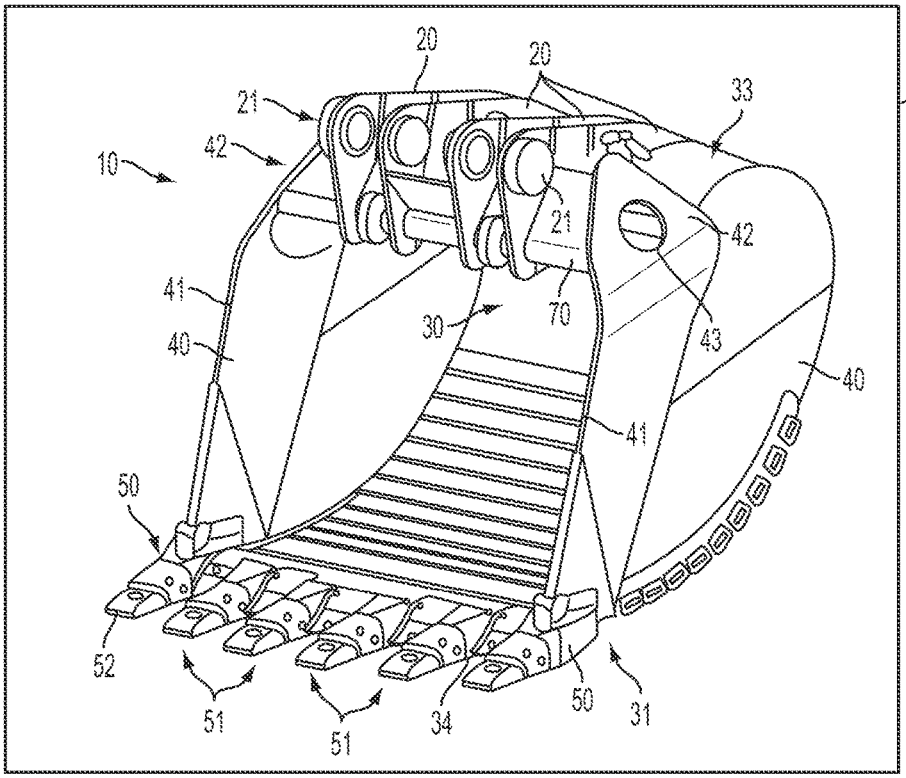
FIG. 1 shows a perspective side view of an excavator bucket according to the present disclosure.
Figure 2:
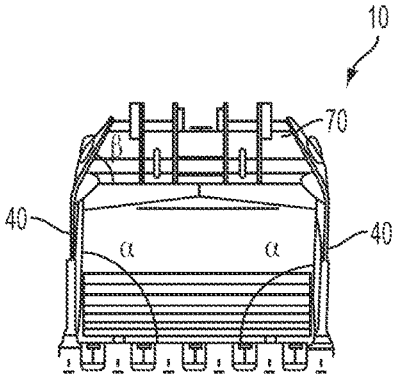
FIG. 2 shows a front view of the bucket according to FIG. 1.

FIGS. 1-4 and 6A-B show different views of an excavating bucket 10 according to the present disclosure. FIGS. 1-7 are drawn to scale indicating an example embodiment of particular relative dimensions, such as lengths, widths, thickness, curvature, positioning, etc., relative to each others. However, alternative relative dimensions may be used, if desired. The excavating bucket 10 comprises four attachment devices, four flanges 20 in this example, arranged for connecting the excavating bucket 10 to an excavator, in particular a mining excavator. Other attachment devices may be used, such as tabs.

A respective earth moving machine, such as excavator machine 100 comprises a movable arm configured to receive the openings 21 of the attachment flanges 20. The movable arm is usually activated by hydraulic devices in such a way that material to be moved can be grabbed with the inventive bucket.

The bucket shown in the figures has a rear wall 30, which is separated into a base portion 31 and an opposed top portion 33. A pair of opposed sidewalls 40 is located between the base portion 31 and the top portion 33. Each of the walls has a front edge together defining the opening to the bucket interior space. The front edge of the sidewalls 40 is marked with the reference sign 41 wherein the front edge of the base portion 31 of the rear wall 30 is named as the bucket lip which is marked with the reference sign 34.

Further, six bucket teeth are arranged at the bucket lip 34 to optimize the grabbing process of the earth moving machine. Two corner adapters 50 are located at the intersection point between the bucket lip 34 and the sidewalls 40, wherein said corner tooth adapters 50 are connected to the lip 34 as well as to the respective sidewall 40.

Another four tooth adapters 51 are disposed between the corner adapters 50 along the bucket lip 34. Bucket teeth 52 of different type and size can be detachable connected to the bucket by slipping them onto the compatible tooth adapters 50, 51.

The present disclosure recommends optimising the ratio between the bucket volume and the bucket weight by at least one of the following implementations.

First of all, the angle $\alpha$ (FIG. 2) between the sidewalls 40 and the base portion 31 of the rear wall 30 is increased to expand the available bucket volume. The angle should take a value of more than 90 degrees.

With an angle $\alpha$ greater than 90 degrees the bucket capacity can be expanded without a perceptible increase of the total bucket weight. With a given lip width the bucket width can be increased on sidewall-level so that the bucket volume is increased.

Further, the bucket 10 comprises a bucket box 70 with a polyhedral design and which is arranged on the top surface of the bucket 10, in particular on the top surface of the top portion 33 of the rear wall 30. A detailed illustration of the bucket box 70 is given in FIGS. 5A-C.

The longitudinal axis A of the bucket box extends along the lateral direction of the bucket 10. The cross-sectional area 71 of the bucket box 70 along its lateral intersection axis B-B shows four rounded corners connected over four sides which differ from each other in their side length and orientation. The body of the bucket box 70 is hollow. A circular opening 73 is arranged in the middle of the top portion of the bucket box 70.

The front sides 72 of the bucket box are inclined so that the upper edge 74 of the bucket box is shortened compared to the remaining box edges along the longitudinal axis A. In detail, the front sides 72 of the bucket box 70 and the top portion 33 of the rear wall 30 draw an angle $\beta$ (FIGS. 2, 6) which is less than 90 degrees. Therefore, a reduction of the bucket box weight can be achieved wherein the volume of the bucket box remains constant. The outer lateral sides 72 of the bucket box 70 are covered by inclined parts 42 of the bucket sidewalls 40. Both parts 42 include an opening to the interior of the bucket box 70.

The rear wall 30 of the bucket 10 consists of two metal sheets 36, 37 which are welded together to get a cambered or round shaped rear wall 30. As can be seen from FIG. 6B the two metal sheets 36, 37 are arranged along the welding line 38 inclined to each other. Each of the two metal sheets forms an angle $\gamma$ against the straight line B crossing the welding line 38. The inclination against the straight line B of each metal sheet 36, 37 leads to a further weight reduction of the total bucket weight. Moreover, the wear of the bucket rear wall 30 can be significantly reduced.

Figure 3:
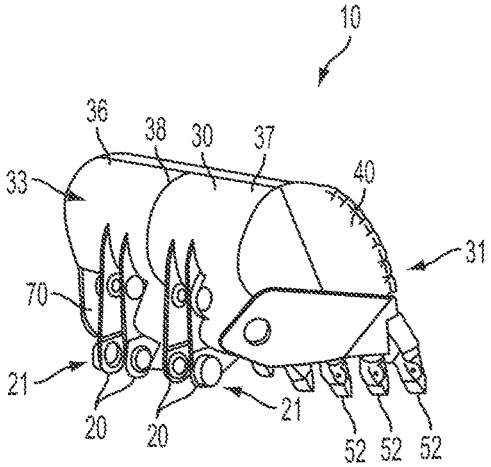
FIG. 3 shows a perspective view of the bucket according to FIG. 1 from below.
Figure 4:
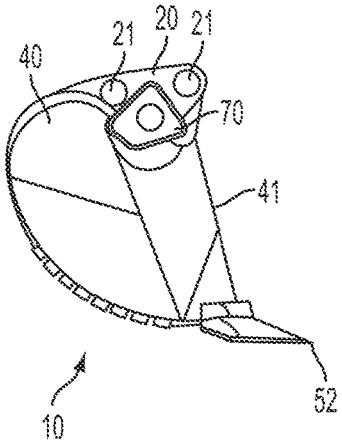
FIG. 4 shows a side view of the inventive bucket.
Figure 5A:
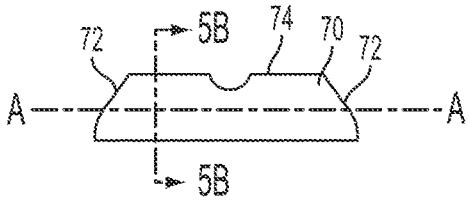
FIGS. 5A-C show detailed views of the bucket box.
Figure 5B:
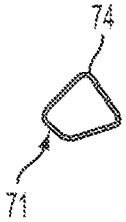
Figure 5C:
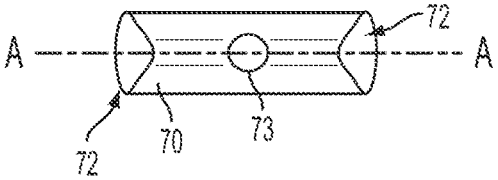
Figure 6A:
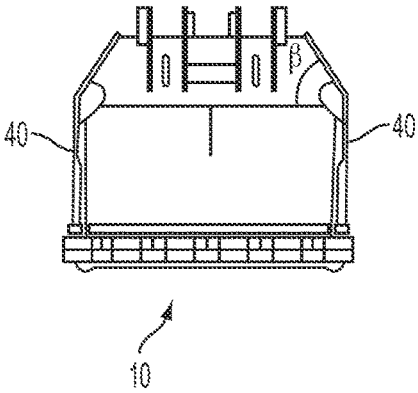
FIGS. 6A-B show two front views of the inventive bucket.
Figure 6B:
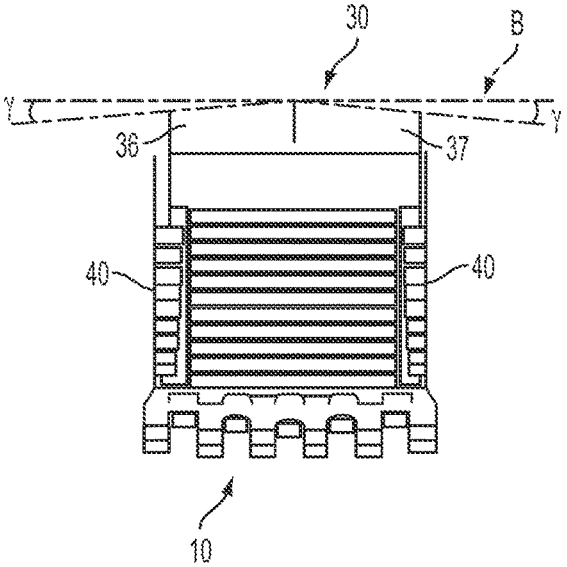

The metal sheets are neither pressed nor molded. They are laminated, cut and welded together. The welding line 38 as shown in FIG. 3 connects the two metal sheets 36, 37 together. Further, the side views of FIGS. 3 and 4 point out the resulting circular shape of the bucket rear wall which brings forth a further optimised volume to weight ratio of the bucket 10.

In detail, the portions of the rear wall, including each metal sheet 36, 37 of the rear wall, are arranged inclined to each other. In the example, the angle γ is the angle as shown or 3°.

Figure 7:
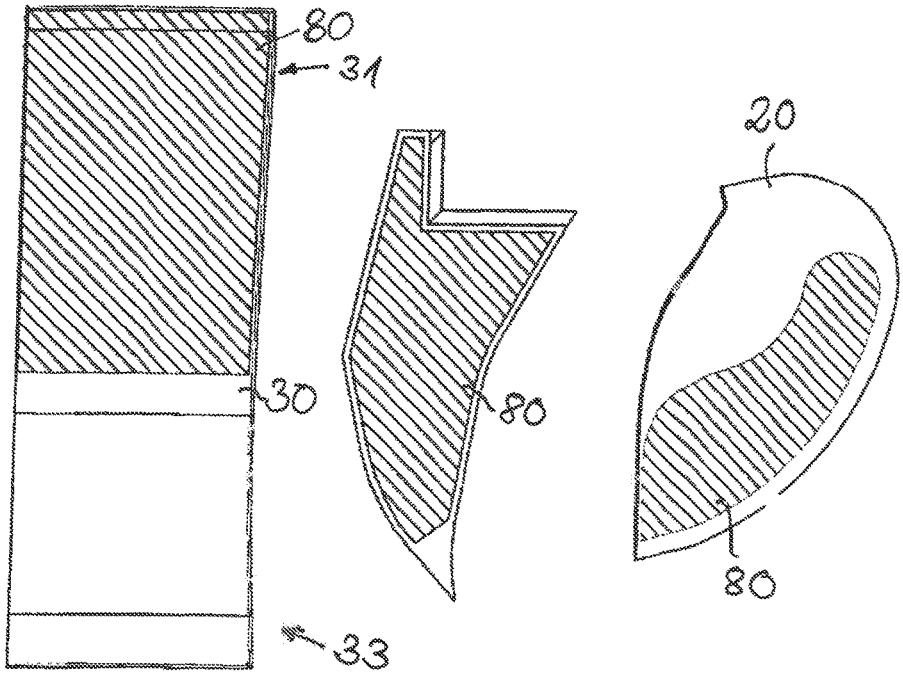
FIG. 7 shows schematic views of structural bucket parts.

Instead of using known wear packages the present disclosure focuses on carbide overlays which are disposed directly on some structural parts of the bucket 10. FIG. 7 shows different structural parts of the bucket 10. On the left side, the inner surface of the rear wall 30 is shown wherein the hedge area 80 constitutes the recharging surface which comprises the carbide overlay. The structural part in the middle of FIG. 7 discloses a portion of the bucket close to the bucket lip 34 wherein the structural part depicted on the right side is a first sidewall 40 of the bucket 10. Both structural parts show hedged areas 80 which constitutes the carbide overlay for increasing the hardness and resistance of the bucket material.

The carbide overlay on the structural parts is disposed after the cutting process during manufacturing of the bucket 10 and before forming and welding the bucket 10. The overlaying is still feasible with a mechanical process.

The used carbides comprise tungsten which has appropriate properties to increase the hardness and resistance of the bucket 10 during the complete bucket lifetime. This enables reducing the global weight as the recharging is done directly on the bucket structure.

The disclosure further includes an example method of form an excavator bucket for an earth moving machine, comprising: forming an interior bucket space by a curved rear wall and a pair of opposed sidewalls, wherein the bucket comprises a bucket box arranged onto the rear wall and which extends along a lateral axis of the bucket, wherein an angle between at least one of outer lateral sides of the bucket box and the rear wall of the bucket, is less than 90 degrees; and disposing a carbide overlay including tungsten at least partly on one or more structural parts of the bucket after a cutting process and before a forming and welding process of the bucket, wherein the overlaying is optionally performed by a mechanical process.

It should be noted that the Figures may show various components directly coupled to one another, and in such cases show the components contiguous with one another, although alternative approaches may also be used.

The invention claimed is:

1. An excavator bucket for an earth moving machine, comprising:

an interior bucket space formed by a curved rear wall and a pair of opposed sidewalls, each sidewall including an inclined part and a non-inclined part, wherein the curved rear wall includes a top portion and a base portion, wherein the sidewalls are located between the top and base portions, wherein the bucket comprises a bucket box arranged on an outer surface of the top portion of the rear wall, the bucket box extending along a lateral axis of the bucket and including a pair of outer lateral sides covered by the inclined parts of the sidewalls, wherein an angle between at least one of the inclined parts of the sidewalls and the top portion of the rear wall of the bucket is less than 90 degrees, and wherein an angle between at least one of the non-inclined parts of the sidewalls and a front edge of the base portion of the rear wall is greater than 90 degrees.

2. The excavator bucket according to claim 1, wherein the angle between the non-inclined part of at least one sidewall and the top portion of the rear wall is greater than 90 degrees, and wherein the front edge of the base portion of the rear wall is a bucket lip to which a plurality of bucket teeth are attached.

3. The excavator bucket according to claim 1, wherein the bucket box is hollow and includes a four-sided cross-section area with rounded corners wherein the sides of the cross-section area differ from each other in each of their length and orientation.

4. The excavator bucket according to claim 1, wherein the top portion of the rear wall includes two metal sheets connected at a welding line, the welding line extending in a longitudinal direction of the rear wall, to form a cambered/round shaped rear wall, and wherein the metal sheets are inclined to each other and each metal sheet forms an angle γ against a straight line which crosses the welding line.

5. The excavator bucket according to claim 4, wherein the two metal sheets are laminated, with a welded joint therebetween.

6. The excavator bucket according to claim 1, wherein a carbide overlay is disposed at least partly on one or more structural parts of the bucket.

7. The excavator bucket according to claim 6, wherein the carbide overlay includes tungsten.

8. The excavator bucket according to claim 7, wherein the carbide overlay is disposed on one or more structural parts of the bucket after a cutting process and before a forming and welding process of the bucket.

9. The excavator bucket according to claim 6, wherein the overlaying is performed by a mechanical process.

10. The excavator bucket according to claim 1, wherein the top portion of the rear wall forms at least partly a circular shape.

11. The excavator bucket according to claim 1, wherein the bucket comprises at least one attachment flange for attaching the bucket to an excavator arm of the earth moving machine.

12. The excavator bucket according to claim 11, wherein at least one attachment flange is connected to the bucket box and/or the rear wall.

13. The excavator bucket according to claim 11, wherein at least one attachment flange is connected to a top portion of the bucket box.

14. The excavator bucket according to claim 12, wherein at least one attachment flange comprises at least two openings as matching devices for a suitable connection mechanism of the excavator arm.

15. An earth moving machine comprising the excavator bucket according to claim 1.

16. A method for an excavator bucket for an earth moving machine, comprising:

forming an interior bucket space by a curved rear wall and a pair of opposed sidewalls located between top and base portions of the rear wall, each sidewall including an inclined part and a non-inclined part, wherein the bucket comprises a bucket box arranged on an outer surface of the top portion of the rear wall, the bucket box extending along a lateral axis of the bucket and including a pair of outer lateral sides covered by the inclined parts of the sidewalls, wherein an angle between at least one of the inclined parts of the sidewalls and the top portion of the rear wall of the bucket is less than 90 degrees, wherein an angle between at least one of the non-inclined parts of the sidewalls and a front edge of the base portion of the rear wall is greater than 90 degrees, and wherein the bucket comprises at least one attachment device for attaching the bucket to an excavator arm of the earth moving machine, the at least one attachment device connected to a top portion of the bucket box; and disposing a carbide overlay including tungsten at least partly on one or more structural parts of the bucket after a cutting process and before a forming and welding process of the bucket.

17. The method of claim 16, wherein the overlaying is performed by a mechanical process.

18. The method of claim 16, wherein the front edge of the base portion of the rear wall is a bucket lip to which a plurality of bucket teeth are attached.

19. The method of claim 16, wherein the at least one attachment device comprises at least two attachment flanges, each attachment flange having one or more openings for a releasable connection of the bucket to the excavator arm of the earth moving machine, and wherein the at least one attachment device comprises four attachment flanges.

20. The method of claim 16, wherein the top portion of the rear wall includes two metal sheets connected at a welding line, the welding line extending in a longitudinal direction of the rear wall, and wherein the metal sheets are inclined to each other and each metal sheet forms an angle $\gamma$ against a straight line which crosses the welding line.

* * * * *